US006484729B1

(12) United States Patent
Silva

(10) Patent No.: US 6,484,729 B1
(45) Date of Patent: Nov. 26, 2002

(54) HAIR SEWING FASTENER

(76) Inventor: David Alan Silva, 632 Loma Prieta, Aptos, CA (US) 95003

( * ) Notice: Subject to any disclaimer, the term of this patent is extended or adjusted under 35 U.S.C. 154(b) by 0 days.

(21) Appl. No.: 09/759,940

(22) Filed: Jan. 13, 2001

(51) Int. Cl.[7] ..... A45D 24/00; A45D 8/04
(52) U.S. Cl. ..... 132/200; 132/273
(58) Field of Search ..... 132/273, 275, 132/128, 200, 101, 248, 251, 323, 281; 24/3.13, 3.1, 300, 58, 712

(56) References Cited

U.S. PATENT DOCUMENTS 4,050,470 A * 9/1977 Miller ..... 132/323
4,133,339 A * 1/1979 Naslund ..... 132/323
4,403,625 A * 9/1983 Sanders et al. ..... 132/323
5,224,501 A * 7/1993 McKenzie ..... 132/323
5,685,325 A * 11/1997 Wei et al. ..... 132/323
5,954,065 A * 9/1999 Silva ..... 132/273
6,065,480 A * 5/2000 Mader ..... 132/323

* cited by examiner

*Primary Examiner*—John J. Wilson
*Assistant Examiner*—Robyn Kieu Doan

(57) ABSTRACT

Each end of a resilient band is attachable and detachable to each end of two needles. In use the first needle is placed in hair, the needle and band are sewn through the hair; the second needle is placed into the hair to secure; and the fastener is removable and reusable by detaching the needles from the band.

5 Claims, 5 Drawing Sheets

HAIR SEWING FASTENER

BACKGROUND OF THE INVENTION

1. Field of the Invention

The present invention and method relates to a hair-sewing fastener.

2. Description of Prior Art

Many people like to put their hair up in various styles. One way to put the hair up is to have a professional hair-stylist sew the hair into an upswept style by using a traditional needle and thread. This process is affective but only lasts a short period of time until the wearer has to cut the thread from the hair. This technique is temporary, time consuming, and costly.

SUMMARY OF THE PRESENT INVENTION

An object of the present invention is to provide an instrument which is convenient, practical, and inexpensive for use in hair sewing and styling.

A further object is to provide such an instrument that can be used unassisted by the individual styling their hair, eliminating the expense of a professional stylist.

A further object is to provide an instrument that can be reused over and over again.

A further object is to provide an instrument that will quickly hold the users hair up in a neatly sewn style.

A further object is to provide a hair-sewing fastener wherein a needle doesn't have to be threaded and tied before use.

A further object is to provide a hair-sewing fastener where a needle portion is secured into the users hair, after sewing, eliminating the process of cutting the needle off the band and tying the band to the hair as one does with traditional hair sewing.

According to one aspect of the present invention, there is provided a hair sewing fastener comprising a tiny resilient band just a little bigger than the needle's tip attached to a larger band, and a needle portion in the shape of a long, narrow triangle or cone shape with a rounded or tapered tip to prevent puncturing the skin of the user. The other end of the band is attached to a second needle attached by any means.

According to the arrangement described above the tiny resilient band is placed on the tip of the needle and slid up its shaft until it is snug at the other end. Because the band is resilient, when it is placed on the tip it can still stretch as it travels up the needle until snug at the other end. By eliminating the process of having to thread an eye of a traditional needle, the current invention allows the user to remove the sewn portion easily by sliding the band off the needle. A traditional needle can't be reversed out of a sewn style making the sewn portion usable only once until cut out of the hair. Further, sliding the band off the needle allows it to be easily removed and reused. Therefore, the current invention eliminates the traditional process of tying the band to the hair; it eliminates cutting the needle out of the hair; it eliminates tying the band's end to the hair after sewing; and finally it substitutes what was once a temporary time-consuming sewing process with a device that can be simply used by a nonhair-stylist and that can conveniently be reused over and over again.

Accordingly a preferred embodiment of the present invention the needles are shaped in a long, narrow triangle or cone shape narrow on one end and wider on the other. The narrow end is rounded or tapered instead of sharp so the needle can be left in the users hair with out harming them. The resilient band is round in diameter and has a first tiny band with an opening the size of the needle's tip attached to a long band for sewing.

Other objects, features and advantages of the present invention will become apparent from the following description of the preferred embodiments given with reference to the accompanying drawings.

DETAILED DESCRIPTION OF THE PREFERRED EMBODIMENTS

Figure 1:
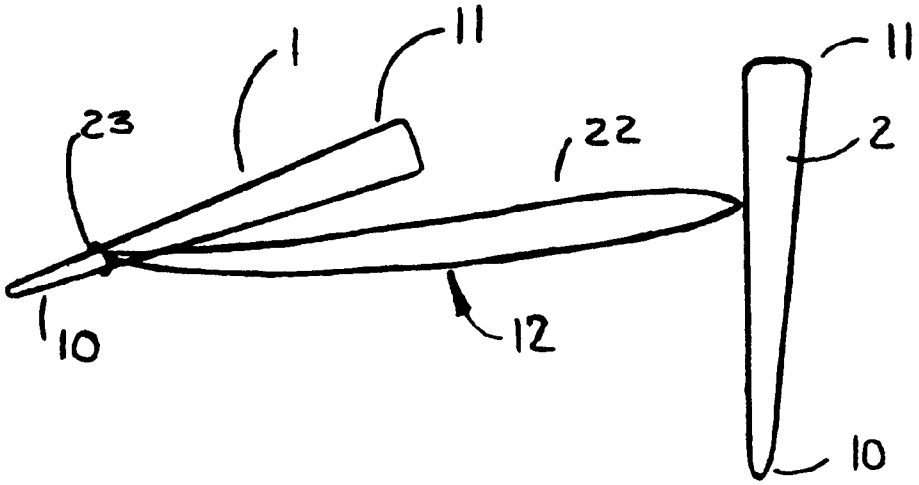
FIG. 1 is a plan view showing two hair-sewing needles and the hair-sewing band according to the present invention.

Referring to FIG. 1 of the accompanying drawings. There is illustrated a hair sewing fastener embodying the present invention. The first needle generally designated by reference numeral 1, comprises a first needle end 10 and a second needle end 11. The second needle generally designated by reference numeral 2 comprises a first needle end 10 and a second needle end 11. The resilient band generally designated by reference numeral 12, comprises a first band end 22 and a second band portion 23. In this embodiment, the needle portions 1 are made of plastic or wood, the band portion 12 is made of some type of resilient thread such as elastic.

To secure the band 12 to the needle the user places the band portion 23 onto tip 10 of needle 1. The user then slides the band 22 up the needle shaft toward the needle end 11. The band 23 slides up the shaft until it is snug to the needle. The other end of the band 22 is unattachably secured to needle 2 by any means.

In use of the present invention described above the needle 2 is placed in the hair. The needle 1 and band 12 are then sewn through hair. The needle 1 is then placed into the hair to secure. To remove the present invention the user pulls the needle 1 off the band 23 and pulls the band 12 and needle 2 out of the hair.

Figure 2:
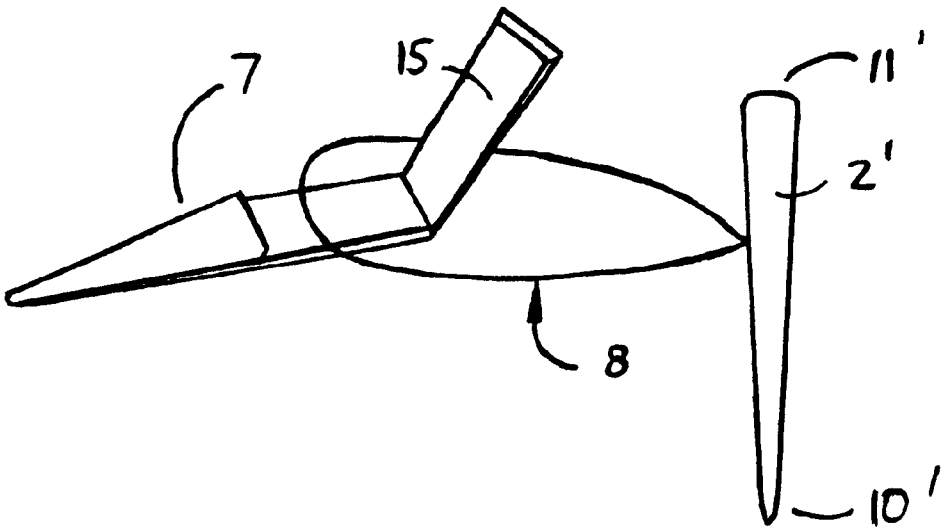
FIG. 2 is a plan view of another embodiment showing the hair-sewing needle with a latch, and the hair-sewing band according to the present invention.
Figure 3:
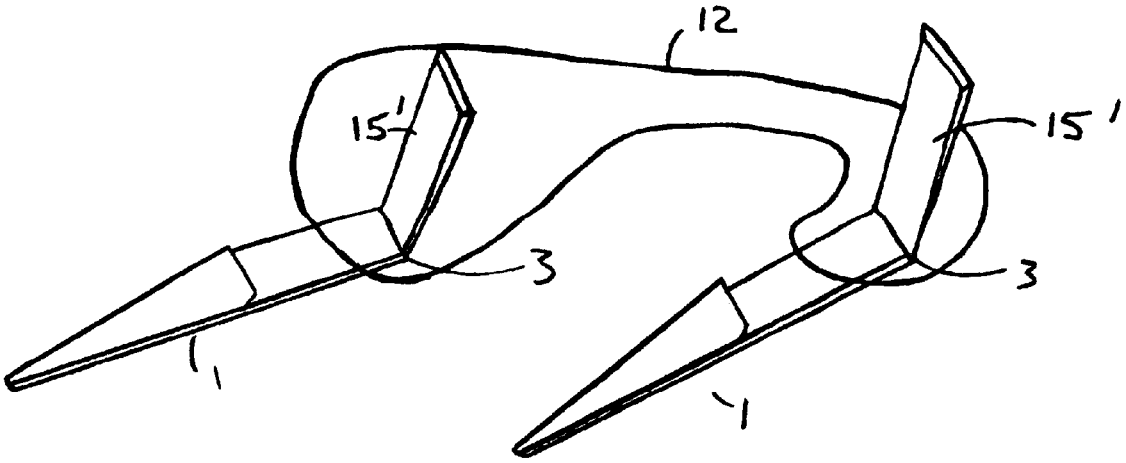
FIG. 3 is a plan view of another embodiment showing two hair sewing needles with latches, and the hair-sewing band attached to each needle's latches according to the present invention.
Figure 4:
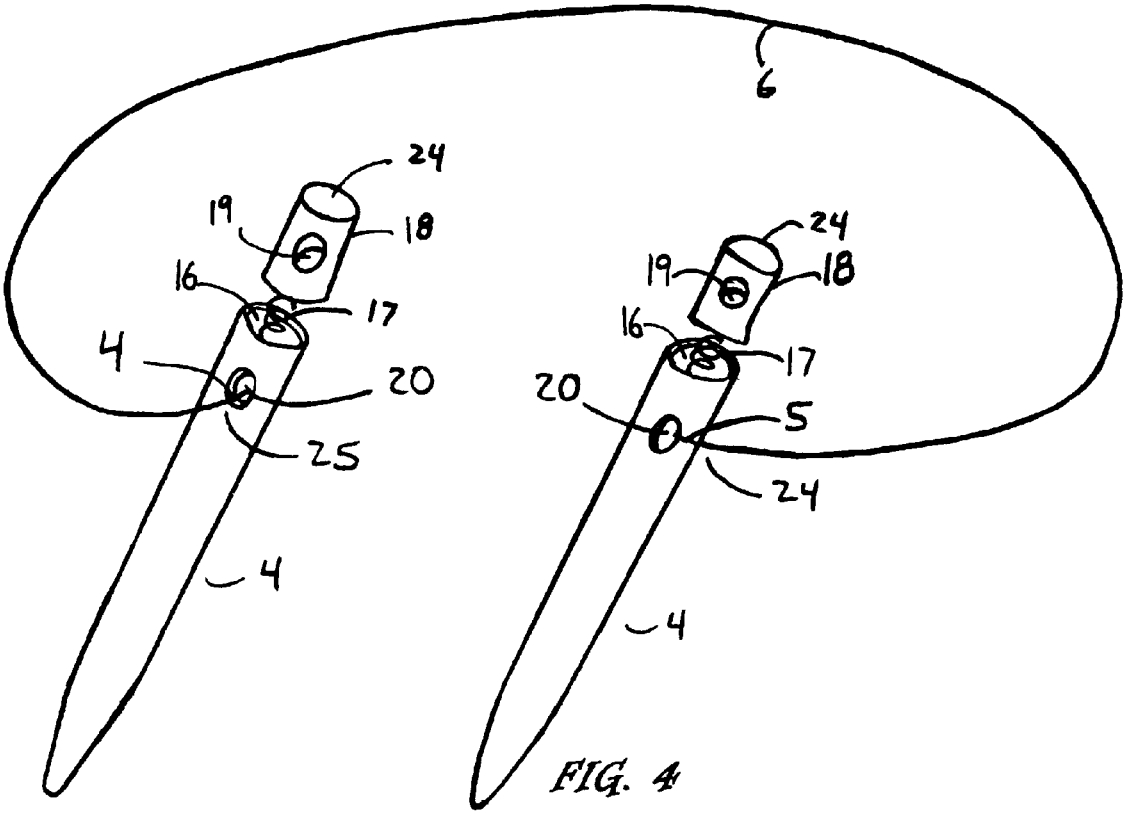
FIG. 4 is a plan view of another embodiment showing two hair sewing needles with spring latches and the hair-sewing band attached to each needle's latches according to the present invention.
Figure 5:
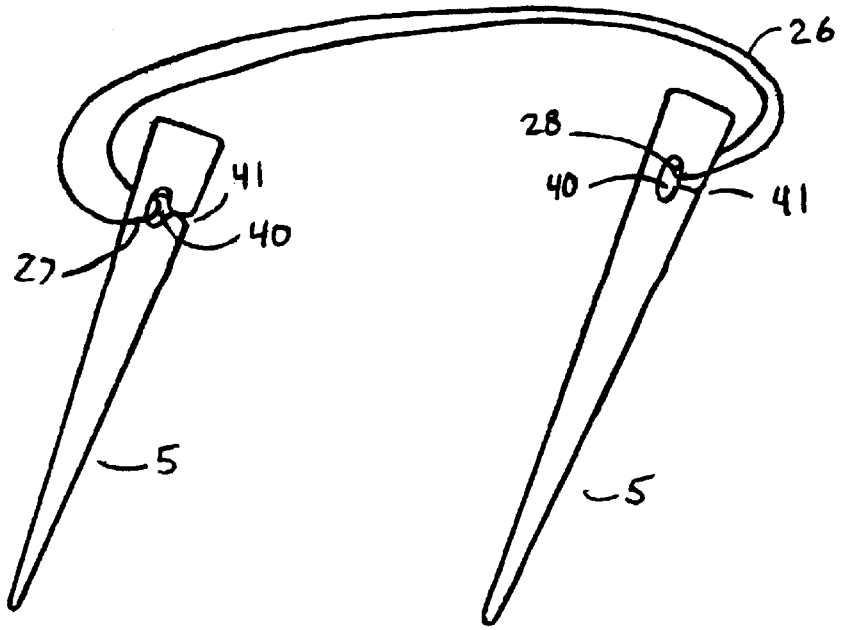
FIG. 5 is a plan view of another embodiment showing two hair sewing needles with an eye and notch toward each needle end and the hair-sewing band attached to each needle according to the present invention.
Figure 6:
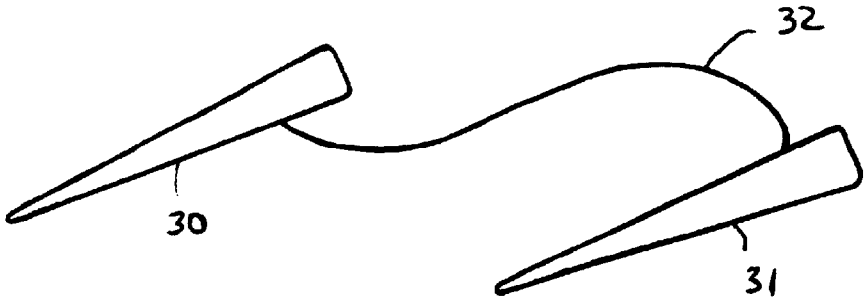
FIG. 6 is a plan view of another embodiment showing two hair sewing needles with each end of a hair-sewing band permanently attached to them according to the present invention.
Figure 7:
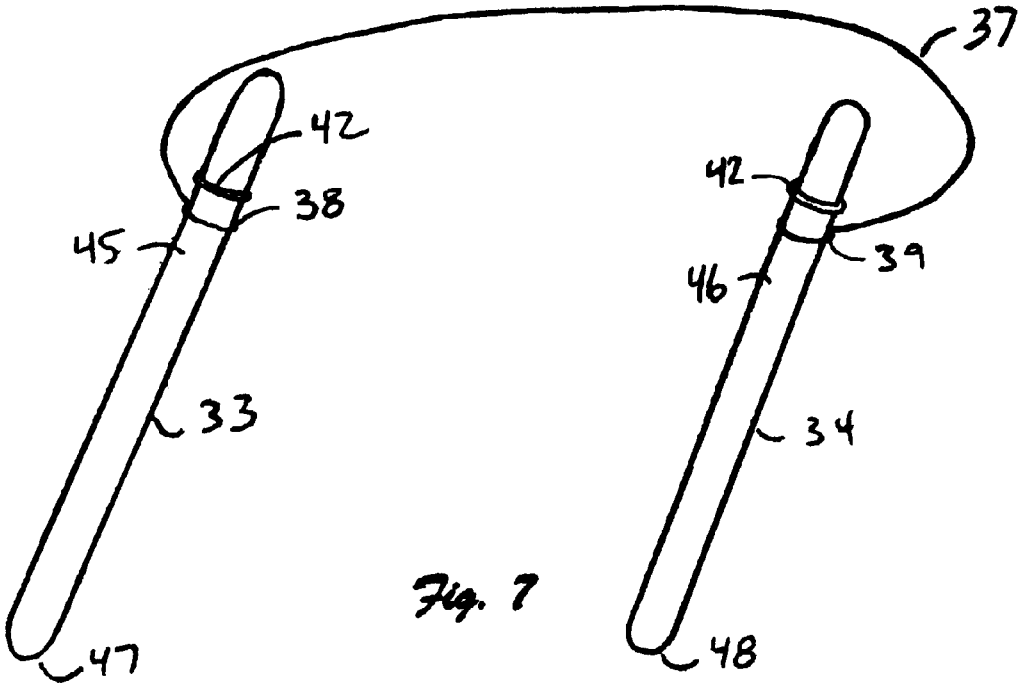
FIG. 7 is a plan view of another embodiment showing two hair sewing needles with a ridge toward each needle end and the hair-sewing band attached to each needle according to the present invention.
Figure 8:
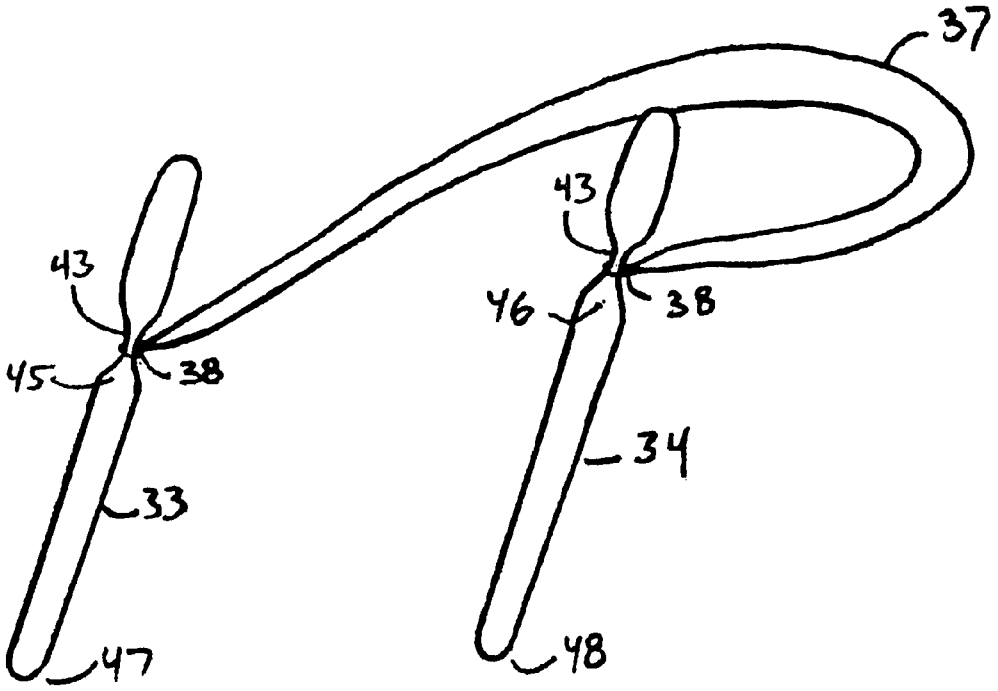
FIG. 8 is a plan view of another embodiment showing two hair sewing needles with a concave notch toward each needle end and the hair-sewing band attached to each needle according to the present invention.
Figure 9:
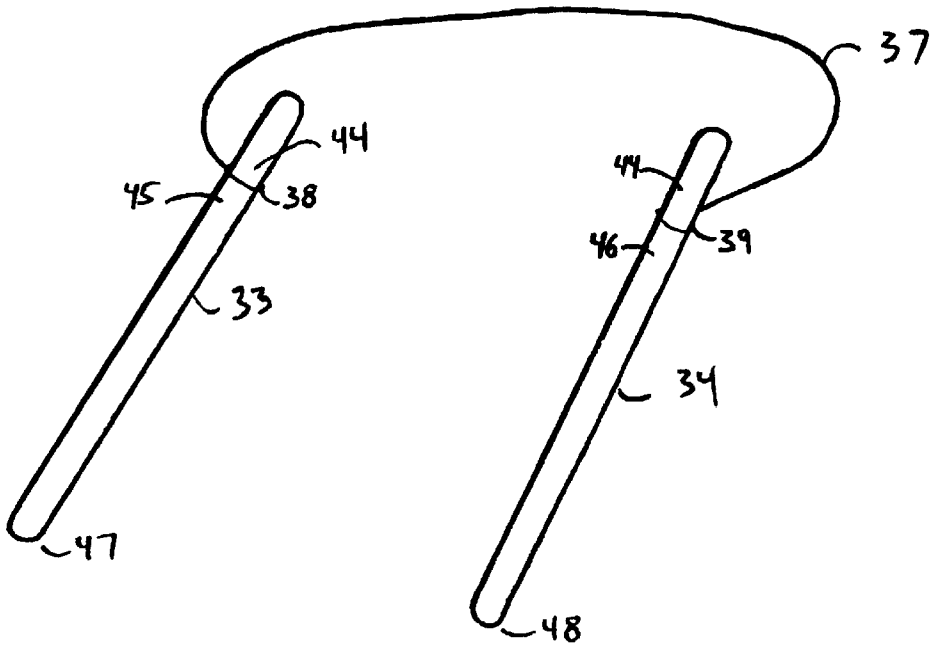
FIG. 9 is a plan view of another embodiment showing two hair sewing needles with a dimple toward each needle end and the hair-sewing band attached to each needle according to the present invention.
Figure 10:
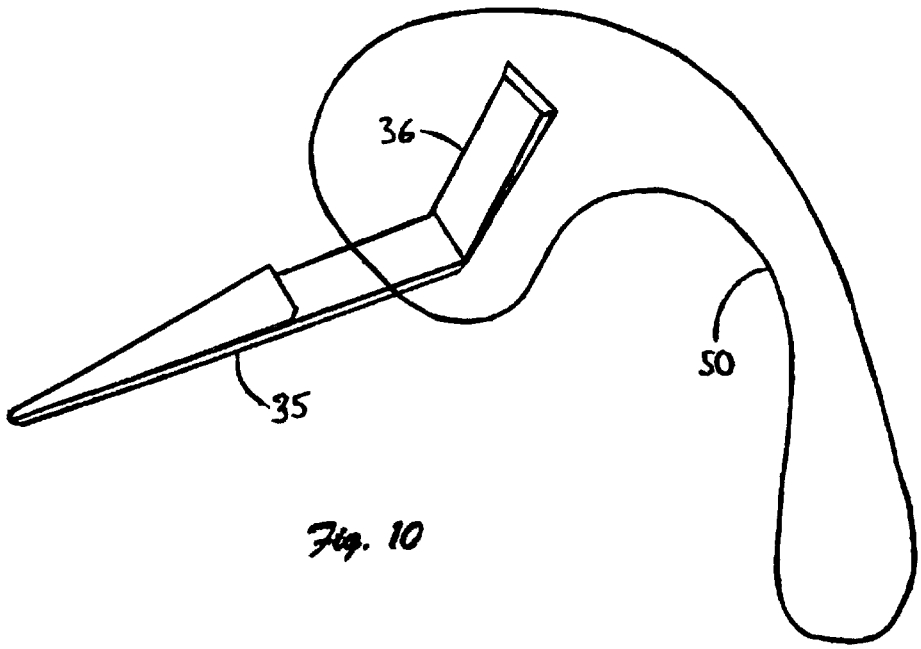
FIG. 10 is a plan view of a single needle with a latch and band of the present invention.

The present invention being thus described, it is obvious that the same may be varied in many ways. For instance FIG. 2 shows that needle 7 can be attached to the band 8 by a latch 15 instead of by a tiny attached band 23 of FIG. 1. Further the latch of needle 7 of FIG. 2 could be on both needles 8 and 9 of FIG. 3 and both latches 15' could be any type of latch that will releasably hold the band to the needle/needles without the latch getting in the way of the sewing process; a few examples of this are shown in FIGS. 3 through 5. FIG. 3 shows the latches 15' hinged to the needle 8 and 9 at hinges 3. FIG. 4 shows a spring latch that works like a cord lock; the top of the needles 4 have an opening 16 where a spring 17 is placed into hole 16 and a separate piece 18 that has a hole 19 through it that is placed in opening 16; the separate piece 18 snaps into the needle 4 and becomes a button 24 that when pressed aligns its hole 19 with hole 20 on the needle 4. The band ends are attached by pressing the button 24, placing each end 24 and 25 of the band 6 into the aligned holes 19 and 20 and releasing the button 24 to unalign the holes 19 and 20 therefore securing the band ends to the needles. In FIG. 5 each needle 5 and eye 40 and each eye has a notch 41 on its side that goes all the way through the needle 5 edge into the eyes 40 opening; to secure the looped band 26 the user places each end 27 and 28 of the looped band 26 into the notch 41. In another embodiment FIG. 6 two needles 30 and 31 are permanently attached to each end of a band 32. In use of this embodiment the first needle 30 is put into upswept hair and left in place. The band 32 is wrapped around and around the first needle 30, and the second needle 31 is placed into the hair to secure. In another embodiment FIG. 7, FIG. 8, and FIG. 9, there is shown two needles 33 and 34. Each needles 33 and 34 has either a raised ridge 42 of FIG. 7, a concave notch 43 of FIG. 8, or a dimple 44 of FIG. 9 toward one end 45 and 46 of the needles 33 and 34. A band 37 has two tiny loops 38 and 39 attached to each end. The band is secured to the needles 33 and 34 by placing an end 47 and 48 of each needle 33 and 34 into the tiny loops 38 and 39 and sliding tip. The dimples 44, ridges 42, or concave notches 43 are there to keep bands 38 and 39 from sliding off the needles 33 and 34 during the sewing process. FIG. 10 is a single needle 35 with a latch 36 and band 50.

Such variations are not to be regarded as a departure from the spirit and scope of the invention, and all such variations as would be obvious to those skilled in the art are intended to be included within the scope of the following claims.

I claim:

1. A hair sewing fastener comprising:

two needle members having a first tapered tip end for placing and leading into said hair, and a second end with a hole in the side of said second end;

a resilient band attached toward said second end of each said needle;

a fastening latch means on said needle members toward said second end for attaching and releasing said band to and from said needles;

each said latch comprises: a separate button member with a hole in a side of each said button member; said button member mates to said needle member by placing said button member into an opening in said needle member with a spring intermediate said button member and said needle member; and, said needle member and said button member have a fastening means for holding said button member to said needle member;

whereby said band can be attached to said needles by pressing said buttons until said holes in said buttons align with said holes in said needle members and placing an end of said band into each said aligned holes; said band can be sewn to said hair, said needles can be placed into said hair to secure; and said needles and said band can be removed from the said hair by releasing said band ends from said fastening latch means.

2. A hair sewing fastener comprising:

a needle member having a first tapered tip end for placing and leading into said hair, and a second end;

a band with a first end and a second end with said first end integrally and permanently attached toward said second end of said first needle member;

a second needle member with a first tapered tip end for placing and leading into said hair, and a second end;

a fastening latch means on said second needle toward said second end at a substantial distance from said first end for attaching and releasing said second band end to and from said second end of said second needle;

whereby said first needle can be placed in said hair, said second needle and band can be sewn through said hair, said second needle can be placed in said hair to secure, and said fastener is reusable and removable by pulling said second band end from said needle by taking off said band from said latch.

3. A method of securing hair comprising:

selecting a hair sewing fastener comprising:

a needle member with a tapered first end and a second end with an elongated looped band attached by a latch means on said needle toward said second end; each said latch comprises a latch member hinged to said needle member with a connection means for releasably connecting said latch member to said needle member;

placing said first tapered end of said needle into hair;

placing a free end of said band onto said tapered first end of said needle;

pulling said needle through said band;

sewing said needle and said band through hair;

securing said needle into hair;

whereby a person's hair is sewn and said needle and said band are easily removable and reusable by releasing said band from said latch.

4. A method of securing hair comprising:

selecting a hair sewing fastener comprising:

a first needle member and a second needle member with each end of an elastic band permanently attached toward the end, but not coming out directly from the end, of each needle;

placing said first needle in said hair and leaving it in place with said first needle end sticking out of one side of said hair section and said second needle end sticking out another side of said hair section;

wrapping said band around and around said first needle by placing it around said first end of said First needle and then around said second end of said First needle and repeating; and, placing said second needle into said hail to secure.

5. A hair sewing fastener comprising:

two needle members having a first tapered tip end for placing and leading into said hair, and a second end;

a resilient band attached toward said second end of each said needle;

a fastening latch means on said needle members toward said second end for attaching and releasing said band to and from said needles;

each said latch comprises a latch member hinged to said needle member with a connecting means for releasably connecting said latch member to said needle member;

whereby said band can be attached to said needles by placing an end of said band into each said latch and closing said latch; said band can be sewn to said hair, said needles can be placed into said hair to secure; and said needles and said band can be removed from the said hair by releasing said band ends from said fastening latch means.

* * * * *